US007146963B2

(12) United States Patent
Tahara

(10) Patent No.: US 7,146,963 B2
(45) Date of Patent: Dec. 12, 2006

(54) STATE DETERMINATION DEVICE FOR INTERNAL COMBUSTION ENGINE

(75) Inventor: Tatsuya Tahara, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/353,979

(22) Filed: Feb. 15, 2006

(65) Prior Publication Data

US 2006/0207558 A1 Sep. 21, 2006

(30) Foreign Application Priority Data

Mar. 18, 2005 (JP) ..... 2005-078311

(51) Int. Cl.
*F02B 7/00* (2006.01)
*F02B 5/00* (2006.01)

(52) U.S. Cl. ..... 123/431; 123/304; 123/432

(58) Field of Classification Search ..... 123/429, 123/431, 432, 434, 294, 299, 304, 305
See application file for complete search history.

(56) References Cited

U.S. PATENT DOCUMENTS 6,606,976 B1 * 8/2003 Nagano et al. ..... 123/431
6,928,983 B1 * 8/2005 Mashiki ..... 123/431
6,973,910 B1 * 12/2005 Ohtani ..... 123/295
6,981,487 B1 * 1/2006 Ohtani ..... 123/406.37
6,988,490 B1 * 1/2006 Satou ..... 123/480
2004/0040550 A1 3/2004 Someno et al.
2005/0166896 A1 * 8/2005 Sadakane et al. ..... 123/431
2005/0183698 A1 * 8/2005 Yonezawa ..... 123/431

FOREIGN PATENT DOCUMENTS

DE 10 2004 006 972 A1 9/2004
EP 1 288 484 A2 3/2003
JP A 3-185242 8/1991
JP A 2000-213398 8/2000
JP A 2000-274296 10/2000
JP A 2004-245108 9/2004

* cited by examiner

*Primary Examiner*—John T. Kwon
(74) *Attorney, Agent, or Firm*—Oliff & Berridge, PLC

(57) ABSTRACT

An engine ECU executes a program including the steps of: determining an airflow meter as abnormal when the number of times an injector is determined as abnormal (abnormality determination count C) is greater than a threshold value C(0) in all of a region where DI ratio r=100%, a region where DI ratio r=0%, and a region where 0%<DI ratio r<100%, and determining the airflow meter as normal when abnormality determination count C is smaller than the threshold value C(0) at least in any one region.

12 Claims, 9 Drawing Sheets

STATE DETERMINATION DEVICE FOR INTERNAL COMBUSTION ENGINE

This nonprovisional application is based on Japanese Patent Application No. 2005-078311 filed with the Japan Patent Office on Mar. 18, 2005, the entire contents of which are hereby incorporated by reference.

BACKGROUND OF THE INVENTION

1. Field of the Invention

The present invention relates to a state determination device for an internal combustion engine that includes a fuel injection mechanism (in-cylinder injector) injecting fuel into a cylinder and a fuel injection mechanism (intake manifold injector) injecting fuel into an intake manifold or an intake port, and more particularly to a technique to determine a state of a detection unit (airflow meter) that detects an intake air amount based on a state of the fuel injection mechanism.

2. Description of the Background Art

An internal combustion engine provided with an intake manifold injector for injecting fuel into an intake manifold and an in-cylinder injector for injecting fuel into a combustion chamber is known.

Japanese Patent Laying-Open No. 2000-274296 discloses a fuel injection control device for an internal combustion engine, the internal combustion engine including a main fuel injection valve directly injecting fuel into a combustion chamber of each cylinder and an auxiliary fuel injection valve in an intake manifold, located upstream of a branch portion of each cylinder, for diagnosing shortage in an amount of fuel injection from the auxiliary fuel injection valve. The fuel injection control device disclosed in Japanese Patent Laying-Open No. 2000-274296 controls a direct injection spark ignition type internal combustion engine including the main fuel injection valve directly injecting fuel into the combustion chamber. The internal combustion engine is provided with the auxiliary fuel injection valve capable of injecting fuel into the intake manifold, separately from the main fuel injection valve, and the fuel injection control device includes a switch control unit actuating the auxiliary fuel injection valve under a prescribed operation condition so as to supply fuel to an engine through the main fuel injection valve and the auxiliary fuel injection valve at a ratio set therebetween, an air-fuel ratio detection unit detecting an air-fuel ratio under the prescribed operation condition, and an auxiliary fuel injection valve diagnosing unit diagnosing abnormality of the auxiliary fuel injection valve based on the air-fuel ratio detected under the prescribed operation condition.

According to the fuel injection control device disclosed in this publication, when an amount of fuel injection from the auxiliary fuel injection valve is insufficient under the prescribed operation condition, the air-fuel ratio becomes leaner relative to a preset air-fuel ratio. The air-fuel ratio detection unit detects such change in the air-fuel ratio, so that the auxiliary fuel injection valve diagnosing unit can diagnose the auxiliary fuel injection valve as abnormal.

The fuel injection control device according to Japanese Patent Laying-Open No. 2000-274296 diagnoses solely abnormality of the auxiliary fuel injection valve. Meanwhile, abnormality of the main fuel injection valve can similarly be diagnosed by observing the air-fuel ratio under an operation condition in which fuel is injected solely from the main fuel injection valve. In general, the amount of fuel injection is determined based on an intake air amount in the internal combustion engine. Accordingly, when an erroneous intake air amount is detected due to abnormality in the airflow meter (an intake air amount detection sensor) as well, the air-fuel ratio may deviate from a desired air-fuel ratio. Japanese Patent Laying-Open No. 2000-274296, however, includes no description of determination of a state of the intake air amount detection sensor.

SUMMARY OF THE INVENTION

An object of the present invention is to provide a state determination device for an internal combustion engine capable of determining a state of an intake air amount detection sensor detecting an amount of air suctioned into the internal combustion engine.

A state determination device for an internal combustion engine according to the present invention determines a state of an internal combustion engine including a first fuel injection mechanism injecting fuel into a cylinder and a second fuel injection mechanism injecting fuel into an intake manifold. The state determination device includes: a first control unit controlling the fuel injection mechanism so that the fuel is injected solely from the first fuel injection mechanism in a first injection region; a second control unit controlling the fuel injection mechanism so that the fuel is injected solely from the second fuel injection mechanism in a second injection region; a third control unit controlling the fuel injection mechanism so that the fuel is injected from the first fuel injection mechanism and the second fuel injection mechanism in a third injection region; an intake air amount detection unit detecting an amount of air suctioned into the internal combustion engine; a calculation unit calculating an amount of fuel injection from the fuel injection mechanism based on the amount of air; an air-fuel ratio detection unit detecting an air-fuel ratio; a first determination unit determining a state of the fuel injection mechanism based on the air-fuel ratio in at least any two of the first injection region, the second injection region and the third injection region; and a second determination unit determining a state of the intake air amount detection unit based on a result of determination by the first determination unit.

According to the present invention, each control unit controls the fuel injection mechanism so that the fuel is injected solely from the first fuel injection mechanism in the first injection region, so that the fuel is injected solely from the second fuel injection mechanism in the second injection region, and so that the fuel is injected from the first fuel injection mechanism and the second fuel injection mechanism in the third injection region. The intake air amount detection unit (intake air amount detection sensor) detects the amount of air suctioned into the internal combustion engine, and the amount of fuel injection from the fuel injection mechanism is calculated based on the amount of air. The air-fuel ratio is detected, and a state of the fuel injection mechanism in at least any two injection regions is determined based on the air-fuel ratio. For example, if the air-fuel ratio is different from a desired air-fuel ratio (for example, stoichiometric air-fuel ratio), the fuel injection mechanism is determined as abnormal. Here, if the intake air amount detection sensor is abnormal and erroneous amount of air is detected, the amount of injection in all injection regions may be different from the desired injection amount. Therefore, the air-fuel ratio in all injection regions may be different from the desired air-fuel ratio. Accordingly, if the number of times the fuel injection mechanism is determined as abnormal is greater than the predetermined number of times (including "0") in all injection regions for which the state of the fuel injection mechanism has been determined by the first determination unit, the intake air amount detection sensor is determined as abnormal. Abnormality of the intake air amount detection sensor can thus be determined. In this manner, a state determination device for an internal combustion engine capable of determining a state of an intake air amount detection sensor can be provided.

Preferably, the second determination unit determines the intake air amount detection unit as abnormal when the number of times the fuel injection mechanism is determined as abnormal is greater than the predetermined number of times in all injection regions for which the state of the fuel injection mechanism has been determined by the first determination unit.

According to the present invention, if the intake air amount detection sensor is abnormal, the air-fuel ratio differs from the desired air-fuel ratio in all injection regions and the fuel injection mechanism may be determined as abnormal. The intake air amount detection sensor is determined as abnormal in such a case. Abnormality of the intake air amount detection sensor can thus be determined.

Preferably, the second determination unit determines the intake air amount detection unit as normal when the number of times the fuel injection mechanism is determined as abnormal is smaller than the predetermined number of times in at least any one of the first injection region, the second injection region and the third injection region.

According to the present invention, it is likely that an appropriate amount of fuel injection is calculated in the injection region in which the number of times the fuel injection mechanism is determined as abnormal is smaller than the predetermined number of times. Therefore, if only there is one such region, the intake air amount detection unit is determined as normal. The state of the intake air amount detection sensor can thus be determined.

Preferably, the state determination device further includes a third determination unit determining the fuel injection mechanism as abnormal when deviation between an actual time period for fuel injection from the fuel injection mechanism and a predetermined time period is greater than predetermined deviation in an injection region in which the number of times the fuel injection mechanism is determined as abnormal by the first determination unit is greater than the predetermined number of times.

According to the present invention, the third determination unit determines the fuel injection mechanism as abnormal when deviation between the actual time period for fuel injection from the fuel injection mechanism and the predetermined time period is greater than the predetermined deviation in the injection region in which the number of times the fuel injection mechanism is determined as abnormal by the first determination unit is greater than the predetermined number of times. Whether or not the fuel injection mechanism is abnormal can thus accurately be determined.

Preferably, the first fuel injection mechanism is an in-cylinder injector, and the second fuel injection mechanism is an intake manifold injector.

According to the present invention, in the internal combustion engine in which the in-cylinder injector serving as the first fuel injection mechanism and the intake manifold injector serving as the second fuel injection mechanism are separately provided to inject the fuel at a ratio set therebetween, the state of the intake air amount detection sensor can be determined.

Preferably, the intake air amount detection unit is an airflow meter.

According to the present invention, the state of the airflow meter can be determined.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
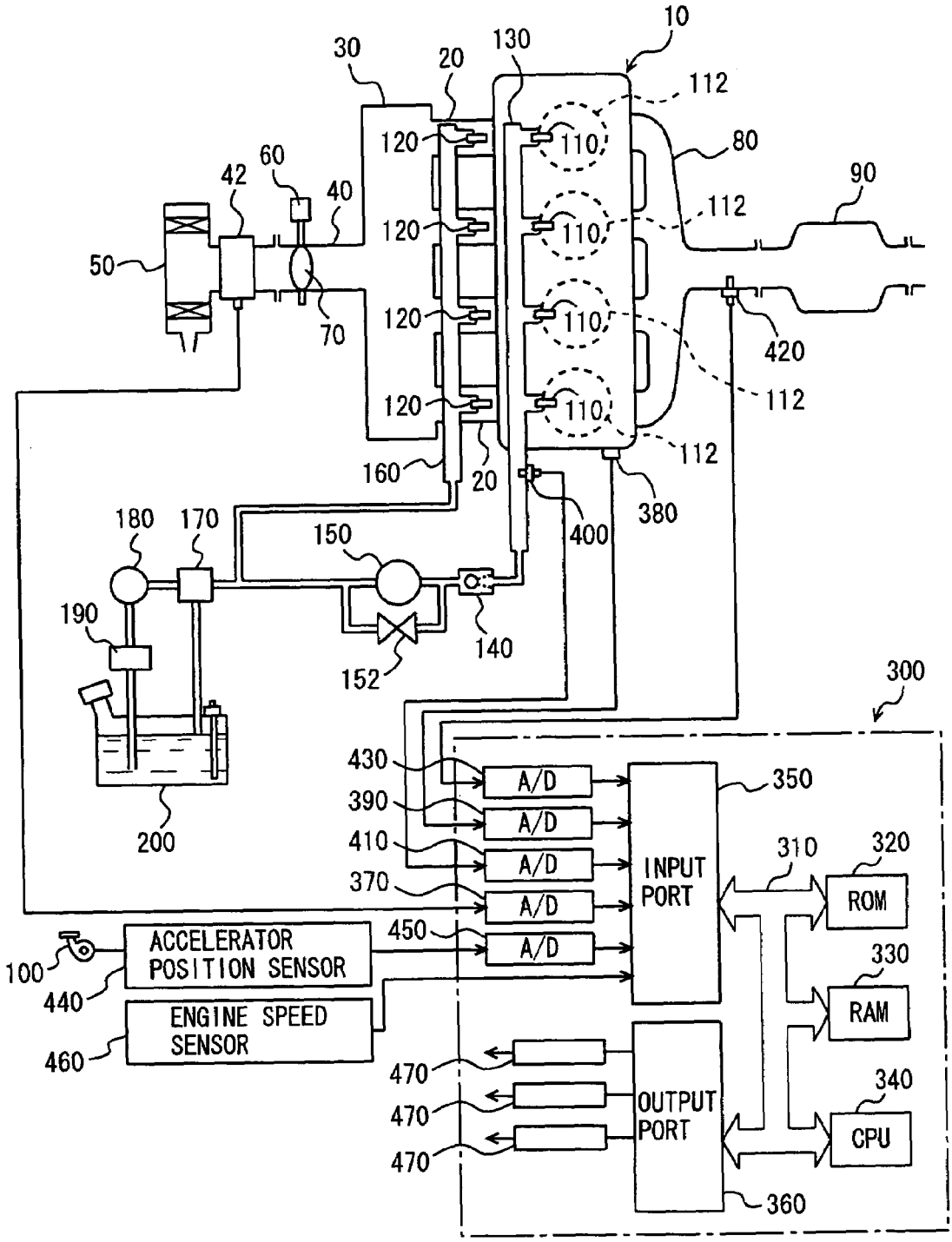
FIG. 1 is a schematic configuration diagram of an engine system controlled by a state determination device according to a first embodiment of the present invention.

An embodiment of the present invention will be described hereinafter with reference to the drawings. The same elements have the same reference characters allotted. Their label and function are also identical. Therefore, detailed description thereof will not be repeated.

First Embodiment

FIG. 1 schematically shows a configuration of an engine system controlled by an engine ECU (Electronic Control Unit) that is a state determination device of an internal combustion engine according to a first embodiment of the present invention. Although an in-line 4-cylinder gasoline engine is shown in FIG. 1, application of the present invention is not restricted to the engine shown, and the present invention is applicable to various types of engines such as a V-type 6-cylinder engine, a V-type 8-cylinder engine and the like.

As shown in FIG. 1, an engine 10 includes four cylinders 112, which are connected via corresponding intake manifolds 20 to a common surge tank 30. Surge tank 30 is connected via an intake duct 40 to an air cleaner 50. In intake duct 40, an airflow meter 42 and a throttle valve 70, which is driven by an electric motor 60, are disposed. Throttle valve 70 has its opening position controlled based on an output signal of an engine ECU 300, independently of an accelerator pedal 100. Cylinders 112 are connected to a common exhaust manifold 80, which is in turn connected to a three-way catalytic converter 90.

For each cylinder 112, an in-cylinder injector 110 for injecting fuel into the cylinder and an intake manifold injector 120 for injecting fuel into an intake port and/or an intake manifold are provided. These injectors 110, 120 are controlled based on output signals of engine ECU 300. In-cylinder injectors 110 are connected to a common fuel delivery pipe 130. Fuel delivery pipe 130 is connected to a high-pressure fuel pump 150 of an engine driven type via a check valve 140 that allows flow toward fuel delivery pipe 130. In the present embodiment, description will be made as to the internal combustion engine having two injectors provided separately, although the present invention is not limited thereto. For example, the internal combustion engine may have a single injector capable of performing both in-cylinder injection and intake manifold injection.

As shown in FIG. 1, the discharge side of high-pressure fuel pump 150 is connected to the intake side of high-pressure fuel pump 150 via an electromagnetic spill valve 152. It is configured such that the amount of the fuel supplied from high-pressure fuel pump 150 to fuel delivery pipe 130 increases as the degree of opening of electromagnetic spill valve 152 is smaller, and that fuel supply from high-pressure fuel pump 150 to fuel delivery pipe 130 is stopped when electromagnetic spill valve 152 is fully opened. Electromagnetic spill valve 152 is controlled based on an output signal of engine ECU 300.

Meanwhile, intake manifold injectors 120 are connected to a common fuel delivery pipe 160 on the low-pressure side. Fuel delivery pipe 160 and high-pressure fuel pump 150 are connected to a low-pressure fuel pump 180 of an electric motor driven type via a common fuel pressure regulator 170. Further, low-pressure fuel pump 180 is connected to a fuel tank 200 via a fuel filter 190. Fuel pressure regulator 170 is configured to return a part of the fuel discharged from low-pressure fuel pump 180 to fuel tank 200 when the pressure of the fuel discharged from low-pressure fuel pump 180 becomes higher than a preset fuel pressure. This prevents the pressure of the fuel supplied to intake manifold injectors 120 as well as the pressure of the fuel supplied to high-pressure fuel pump 150 from becoming higher than the preset fuel pressure.

Engine ECU 300 is configured with a digital computer, which includes a ROM (Read Only Memory) 320, a RAM (Random Access Memory) 330, a CPU (Central Processing Unit) 340, an input port 350, and an output port 360, which are connected to each other via a bidirectional bus 310.

Airflow meter 42 generates an output voltage that is proportional to an intake air amount, and the output voltage of airflow meter 42 is input via an A/D converter 370 to input port 350. A coolant temperature sensor 380 is attached to engine 10, which generates an output voltage proportional to an engine coolant temperature. The output voltage of coolant temperature sensor 380 is input via an A/D converter 390 to input port 350.

A fuel pressure sensor 400 is attached to fuel delivery pipe 130, which generates an output voltage proportional to a fuel pressure in fuel delivery pipe 130. The output voltage of fuel pressure sensor 400 is input via an A/D converter 410 to input port 350. An air-fuel ratio sensor 420 is attached to exhaust manifold 80 located upstream of three-way catalytic converter 90. Air-fuel ratio sensor 420 generates an output voltage proportional to an oxygen concentration in the exhaust gas, and the output voltage of air-fuel ratio sensor 420 is input via an A/D converter 430 to input port 350.

Air-fuel ratio sensor 420 in the engine system of the present embodiment is a full-range air-fuel ratio sensor (linear air-fuel ratio sensor) that generates an output voltage proportional to an air-fuel ratio of the air-fuel mixture burned in engine 10. As air-fuel ratio sensor 420, an $O_2$ sensor may be used which detects, in an on/off manner, whether the air-fuel ratio of the mixture burned in engine 10 is rich or lean with respect to a stoichiometric air-fuel ratio.

In the present embodiment, engine ECU 300 calculates a feedback correction amount for the total fuel injection amount based on the output voltage of air-fuel ratio sensor 420. In addition, when a predetermined learning condition is satisfied, engine ECU 300 calculates a learn value of the feedback correction amount (a value representing constant deviation with regard to the amount of fuel injection). Calculation of the feedback correction amount and the learn value thereof are performed in a learning region predetermined by using an intake air amount as a parameter. The learning region will be described in detail later.

In the present embodiment, when the air-fuel ratio is lean (leaner than the stoichiometric air-fuel ratio), a larger feedback correction amount is calculated. When the air-fuel ratio is rich (richer than the stoichiometric air-fuel ratio), a smaller feedback correction amount is calculated. Here, as a known common technique is used as the method of calculating the feedback correction amount, detailed description thereof will not be repeated.

The learn value is calculated by adding to or subtracting from a previously calculated learn value, an update amount determined based on a map, when a predetermined learning condition is satisfied. The predetermined learning condition includes, for example, such a condition that an average (control median) of feedback correction amounts is smaller than a threshold value (1) or larger than a threshold value (2) (threshold value (2)>threshold value (1)).

As the amount of fuel injection is more excessive (as the actual fuel injection amount is larger than a target fuel injection amount), a smaller learn value is calculated. On the other hand, as the fuel injection amount is less sufficient (as the actual fuel injection amount is smaller than a target fuel injection amount), a larger learn value is calculated. Here, as a known common technique is used as the method of calculating the learn value, detailed description thereof will not be repeated.

The amount of fuel injection is corrected based on the feedback correction amount and the learn value. Specifically, as the feedback correction amount and the learn value are larger, the amount of fuel injection is increased. Meanwhile, as the feedback correction amount and the learn value are smaller, the amount of fuel injection is decreased. In the present embodiment, the correction amount for the fuel injection amount (hereinafter, also referred to as a fuel correction amount) is calculated as the sum of the feedback correction amount and the learn value.

Accelerator pedal 100 is connected to an accelerator position sensor 440 that generates an output voltage proportional to a degree of press-down of accelerator pedal 100. The output voltage of accelerator position sensor 440 is input via an A/D converter 450 to input port 350. An engine speed sensor 460 generating an output pulse representing the engine speed is connected to input port 350. ROM 320 of engine ECU 300 prestores, in the form of a map, values of fuel injection amount that are set corresponding to operation states (such as an intake air amount) based on the engine load factor and the engine speed obtained by the above-described accelerator position sensor 440 and engine speed sensor 460, respectively, and the correction values based on the engine coolant temperature.

Figure 2:
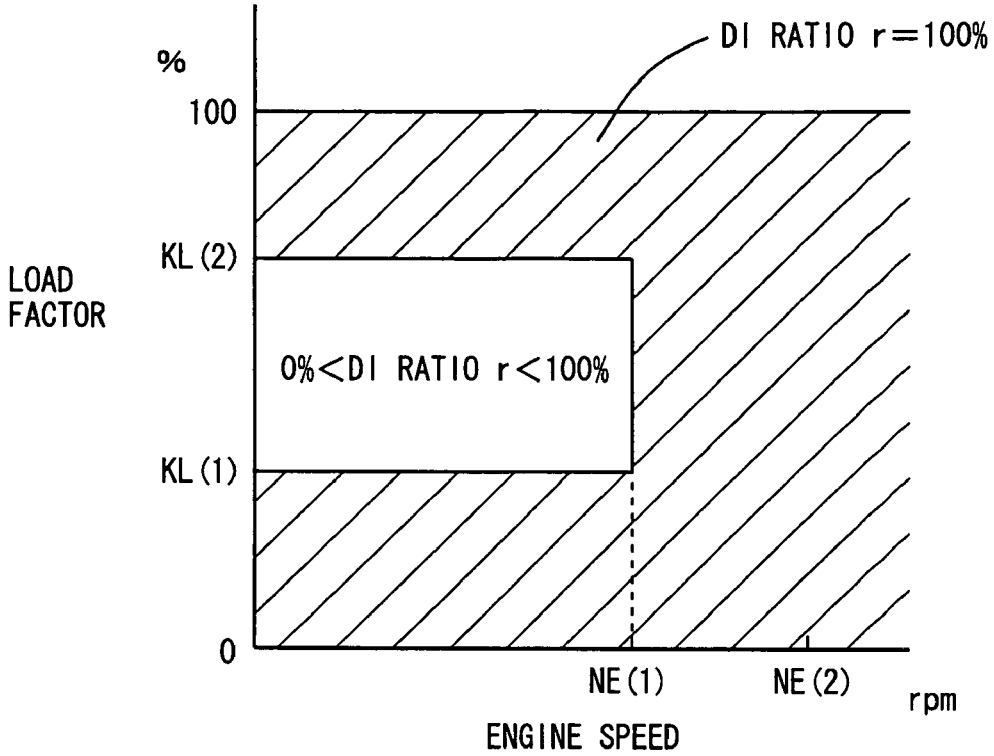
FIGS. 2 and 3 illustrate DI ratio maps in a warm state and a cold state respectively, stored in an engine ECU serving as the state determination device according to the first embodiment of the present invention.
Figure 3:
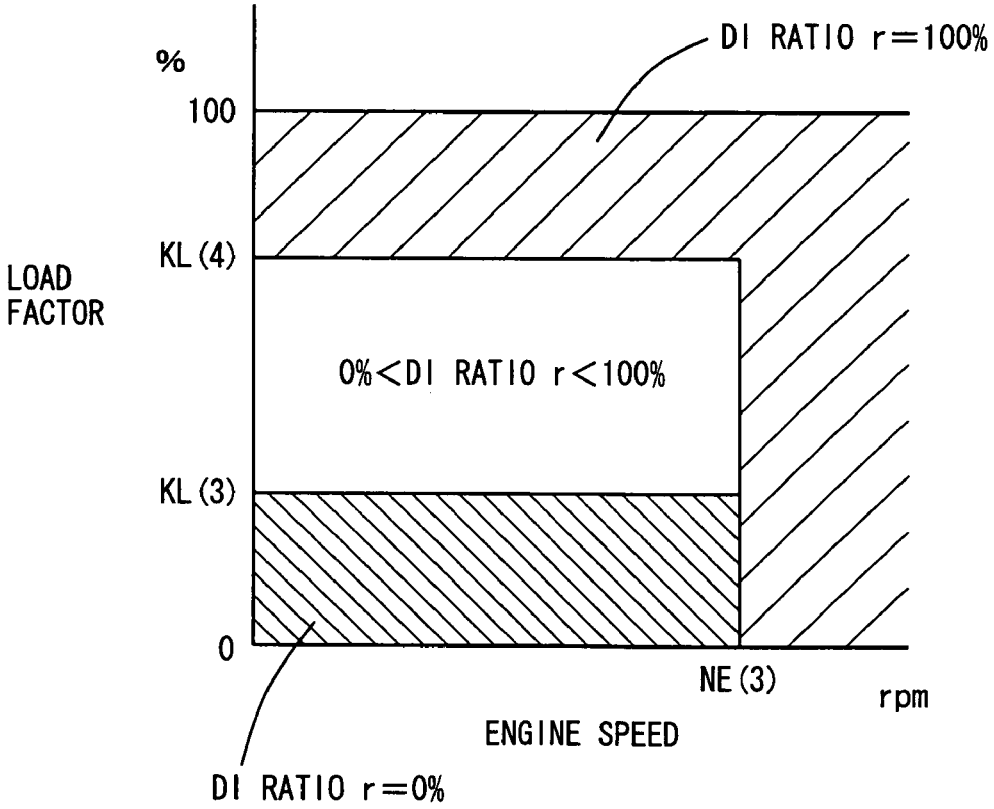

Referring to FIGS. 2 and 3, maps each indicating a fuel injection ratio between in-cylinder injector 110 and intake manifold injector 120 (hereinafter, also referred to as a DI ratio (r)), identified as information associated with an operation state of engine 10, will now be described. The maps are stored in ROM 320 of engine ECU 300. FIG. 2 is the map for a warm state of engine 10, and FIG. 3 is the map for a cold state of engine 10.

In the maps illustrated in FIGS. 2 and 3, with the horizontal axis representing an engine speed of engine 10 and the vertical axis representing a load factor, the fuel injection ratio of in-cylinder injector 110, or the DI ratio r, is expressed in percentage.

As shown in FIGS. 2 and 3, the DI ratio r is set for each operation region that is determined by the engine speed and the load factor of engine 10. "DI RATIO r=100%" represents the region where fuel injection is carried out using only in-cylinder injector 110, and "DI RATIO r=0%" represents the region where fuel injection is carried out using only intake manifold injector 120. "DI RATIO r≠0%", "DI RATIO r≠100%" and "0%<DI RATIO r<100%" each represent the region where fuel injection is carried out using both in-cylinder injector 110 and intake manifold injector 120. Generally, in-cylinder injector 110 contributes to an increase of output performance, while intake manifold injector 120 contributes to uniformity of the air-fuel mixture. These two kinds of injectors having different characteristics are appropriately selected depending on the engine speed and the load factor of engine 10, so that only homogeneous combustion is conducted in the normal operation state of engine 10 (other than the abnormal operation state such as a catalyst warm-up state during idling).

Further, as shown in FIGS. 2 and 3, the fuel injection ratio between in-cylinder injector 110 and intake manifold injector 120, or the DI ratio r, is defined individually in the map for the warm state and in the map for the cold state of the engine. The maps are configured to indicate different control regions of in-cylinder injector 110 and intake manifold injector 120 as the temperature of engine 10 changes. When the temperature of engine 10 detected is equal to or higher than a predetermined temperature threshold value, the map for the warm state shown in FIG. 2 is selected; otherwise, the map for the cold state shown in FIG. 3 is selected. One or both of in-cylinder injector 110 and intake manifold injector 120 are controlled based on the selected map and according to the engine speed and the load factor of engine 10.

In the present embodiment, the amount of fuel injection from in-cylinder injector 110 and the amount of fuel injection from intake manifold injector 120 are determined based on DI ratio r such that the total fuel injection amount attains the desired injection amount.

The engine speed and the load factor of engine 10 set in FIGS. 2 and 3 will now be described. In FIG. 2, NE(1) is set to 2500 rpm to 2700 rpm, KL(1) is set to 30% to 50%, and KL(2) is set to 60% to 90%. In FIG. 3, NE(3) is set to 2900 rpm to 3100 rpm. That is, NE(1)<NE(3). NE(2) in FIG. 2 as well as KL(3) and KL(4) in FIG. 3 are also set as appropriate.

When comparing FIG. 2 and FIG. 3, NE(3) of the map for the cold state shown in FIG. 3 is greater than NE(1) of the map for the warm state shown in FIG. 2. This shows that, as the temperature of engine 10 is lower, the control region of intake manifold injector 120 is expanded to include the region of higher engine speed. That is, in the case where engine 10 is cold, deposits are unlikely to accumulate in the injection hole of in-cylinder injector 110 (even if the fuel is not injected from in-cylinder injector 110). Thus, the region where the fuel injection is to be carried out using intake manifold injector 120 can be expanded, to thereby improve homogeneity.

When comparing FIG. 2 and FIG. 3, "DI RATIO r=100%" in the region where the engine speed of engine 10 is NE(1) or higher in the map for the warm state, and in the region where the engine speed is NE(3) or higher in the map for the cold state. In terms of load factor, "DI RATIO r=100%" in the region where the load factor is KL(2) or greater in the map for the warm state, and in the region where the load factor is KL(4) or greater in the map for the cold state. This means that in-cylinder injector 110 solely is used in the region of a predetermined high engine speed, and in the region of a predetermined high engine load. That is, in the high speed region or the high load region, even if fuel injection is carried out using only in-cylinder injector 110, the engine speed and the load of engine 10 are high, ensuring a sufficient intake air amount, so that it is readily possible to obtain a homogeneous air-fuel mixture even using only in-cylinder injector 110. In this manner, the fuel injected from in-cylinder injector 110 is atomized within the combustion chamber involving latent heat of vaporization (or, absorbing heat from the combustion chamber). Thus, the temperature of the air-fuel mixture is decreased at the compression end, whereby antiknock performance is improved. Further, since the temperature within the combustion chamber is decreased, intake efficiency improves, leading to high power output.

In the map for the warm state in FIG. 2, fuel injection is carried out using only in-cylinder injector 110 when the load factor is KL(1) or less. This shows that in-cylinder injector 110 alone is used in a predetermined low load region when the temperature of engine 10 is high. When engine 10 is in the warm state, deposits are likely to accumulate in the injection hole of in-cylinder injector 110. However, when fuel injection is carried out using in-cylinder injector 110, the temperature of the injection hole can be lowered, whereby accumulation of deposits is prevented. Further, clogging of in-cylinder injector 110 may be prevented while ensuring the minimum fuel injection amount thereof. Thus, in-cylinder injector 110 alone is used in the relevant region.

When comparing FIG. 2 and FIG. 3, there is a region of "DI RATIO r=0%" only in the map for the cold state in FIG. 3. This shows that fuel injection is carried out using only intake manifold injector 120 in a predetermined low load region (KL(3) or less) when the temperature of engine 10 is low. When engine 10 is cold and low in load and the intake air amount is small, atomization of the fuel is unlikely to occur. In such a region, it is difficult to ensure favorable combustion with the fuel injection from in-cylinder injector 110. Further, particularly in the low-load and low-speed region, high output using in-cylinder injector 110 is unnecessary. Accordingly, fuel injection is carried out using only intake manifold injector 120, rather than in-cylinder injector 110, in the relevant region.

Further, in an operation other than the normal operation, or in the catalyst warm-up state during idling of engine 10 (abnormal operation state), in-cylinder injector 110 is controlled to carry out stratified charge combustion. By causing the stratified charge combustion only during the catalyst warm-up operation, warming up of the catalyst is promoted, and exhaust emission is thus improved.

Figure 4:
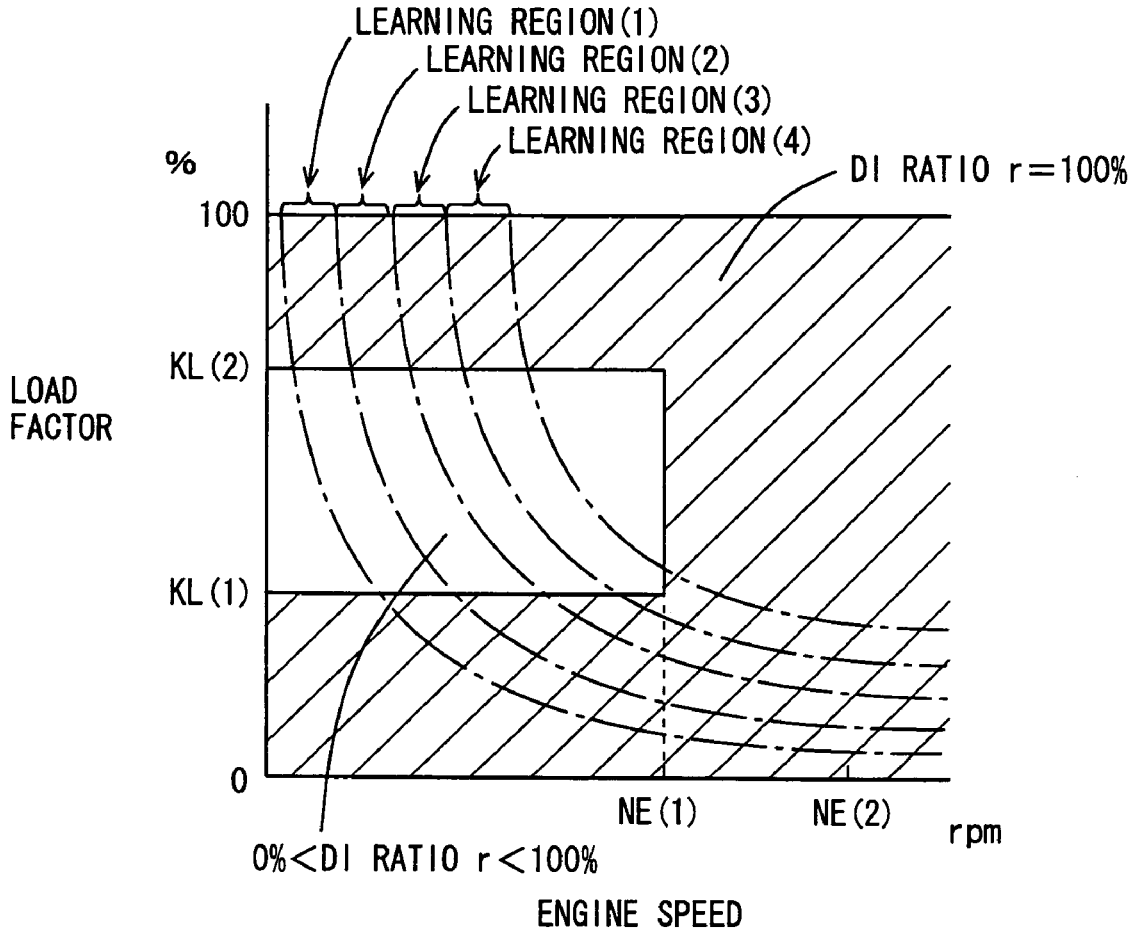
FIG. 4 shows a first diagram showing a learning region of an amount of fuel injection stored in the engine ECU serving as the state determination device according to the first embodiment of the present invention.
Figure 5:
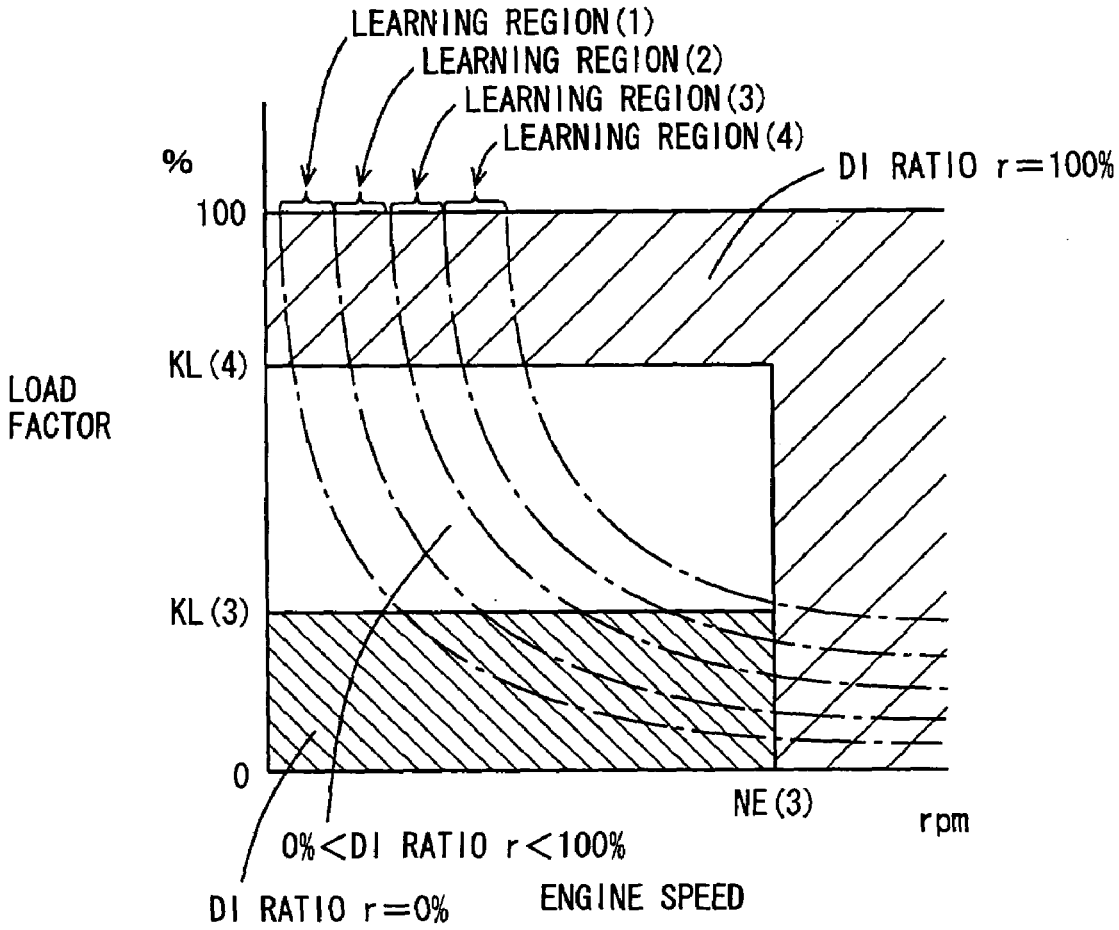
FIG. 5 shows a second diagram showing a learning region of an amount of fuel injection stored in the engine ECU serving as the state determination device according to the first embodiment of the present invention.

Referring to FIGS. 4 and 5, a learning region where a feedback correction amount and a learn value thereof are calculated will now be described. FIG. 4 shows a learning region in the map for the warm state, while FIG. 5 shows a learning region in the map for the cold state.

In FIGS. 4 and 5, regions adjacent to each other delimited by chain dotted curves represent the learning regions. The learning region is divided in accordance with an intake air amount. The learning region is set in accordance with the intake air amount because error in output of airflow meter 42 is different depending on the intake air amount.

In the present embodiment, four learning regions, i.e., learning regions (1) to (4), are provided. The intake air amount is largest in learning region (1), second largest in learning region (2), then learning region (3), and smallest in learning region (4). It is noted that the number of learning regions is not limited to four.

Figure 6:
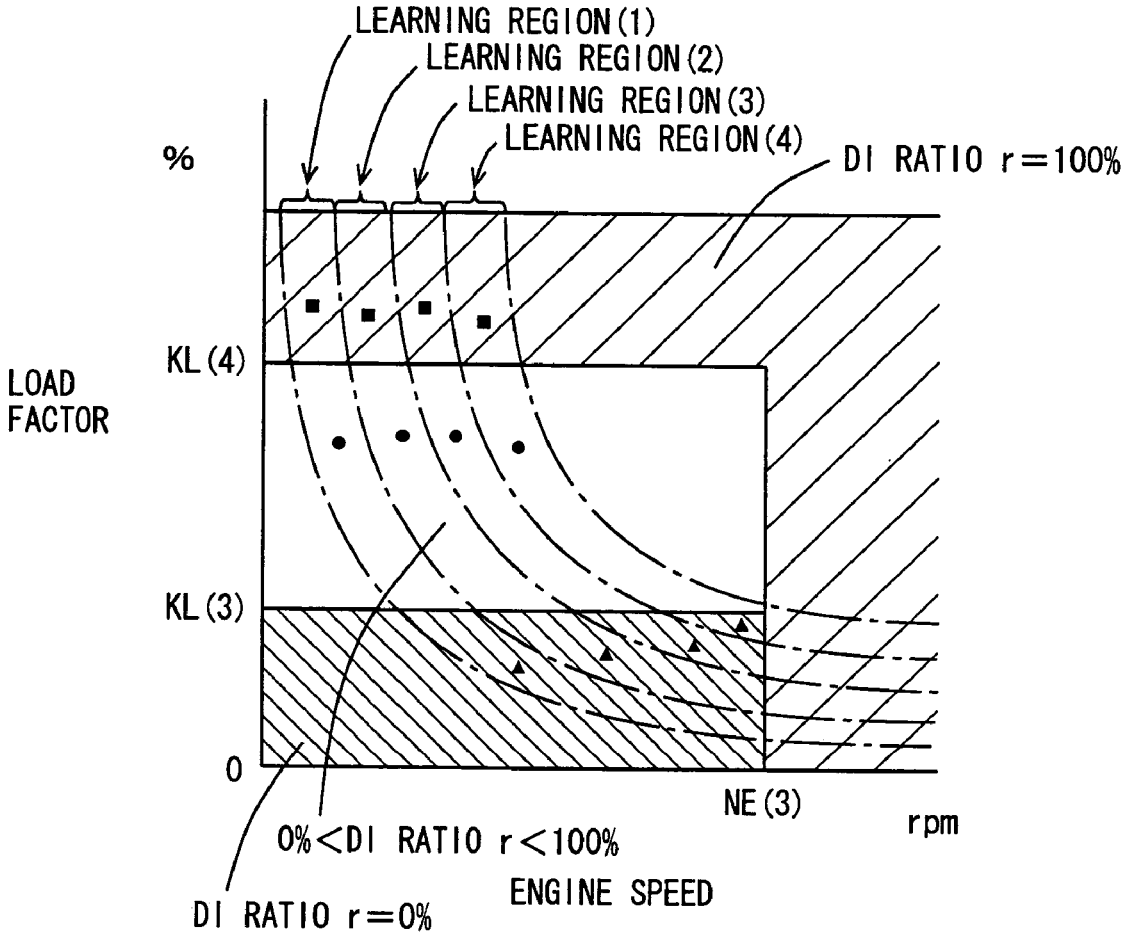
FIG. 6 shows a state in which a learn value has been calculated for each learning region, in each injection region.

In the present embodiment, the feedback correction amount and the learn value thereof are calculated not only for each learning region but also for each injection region (a region where DI ratio r=100%, a region where 0%<DI ratio r<100%, and a region where DI ratio r=0%). In other words, the feedback correction amount is calculated for each learning region in each injection region, and the learn value is calculated in correspondence with the injection region and the learning region, as shown in FIG. 6. FIG. 6 shows a state in which one learn value has been calculated for each learning region in each injection region. In FIG. 6, squares indicate learn values in the region where DI ratio r 100%, circles indicate learn values in the region where 0%<DI ratio r<100%, and triangles indicate learn values in the region where DI ratio r=0%. The calculated learn value is stored in RAM 330.

Figure 7:
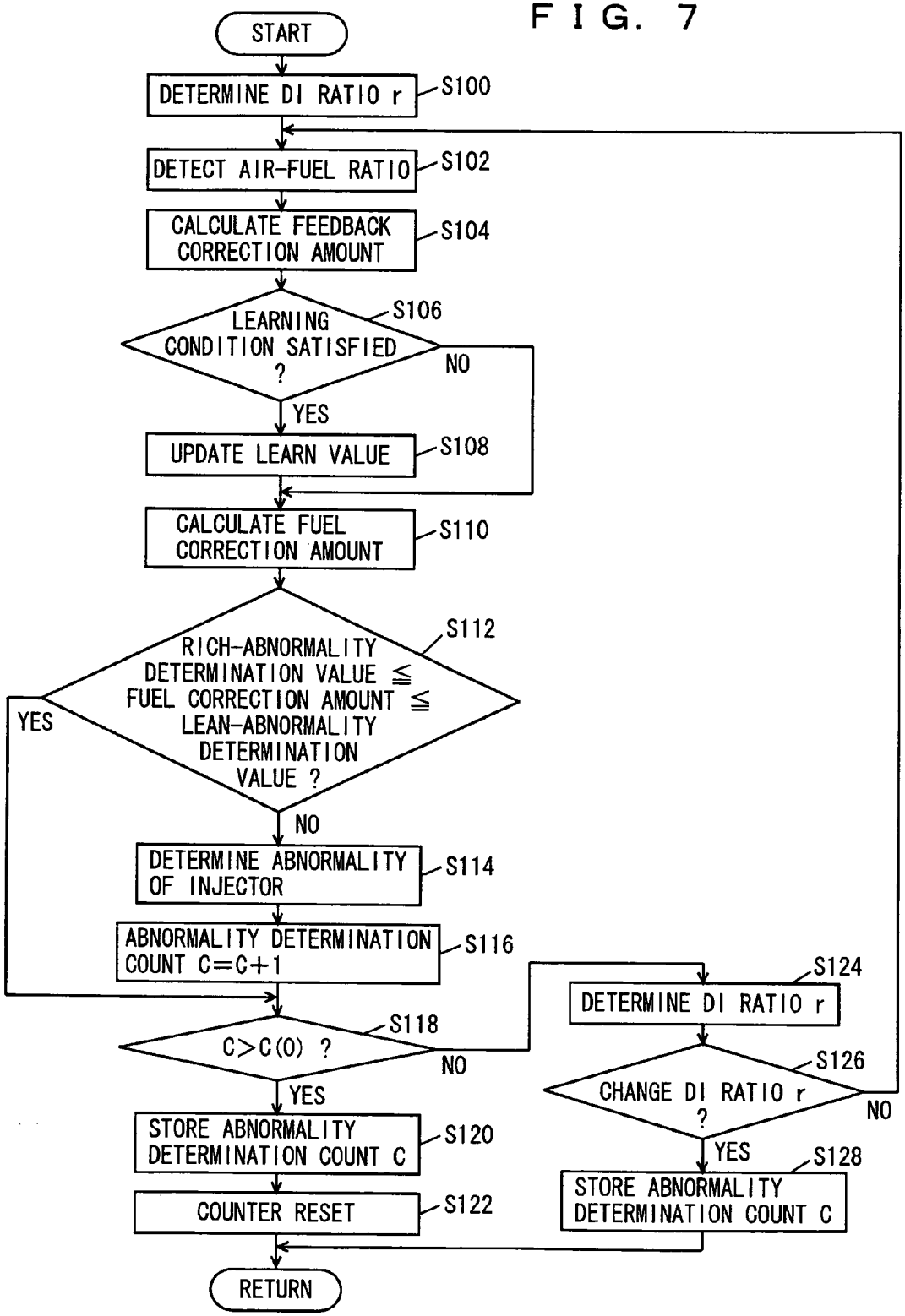
FIG. 7 is a first flowchart showing a control configuration of a program executed by the engine ECU serving as the state determination device according to the first embodiment of the present invention.

A control configuration of a program executed when engine ECU 300 serving as the state determination device for the internal combustion engine according to the present embodiment determines a state of the injector will be described with reference to FIG. 7.

At step (hereinafter, step is abbreviated as S) 100, engine ECU 300 determines DI ratio r based on the maps shown in FIGS. 2 and 3. At S102, engine ECU 300 detects the air-fuel ratio based on a signal transmitted from air-fuel ratio sensor 420. At S104, engine ECU 300 calculates the feedback correction amount for the fuel injection amount based on the detected air-fuel ratio.

At S106, engine ECU 300 determines whether or not the learning condition of the learn value has been satisfied. As described above, the learning condition may be such that an average (control median) of the feedback correction amounts is smaller than threshold value (1) or larger than threshold value (2) (threshold value (2)>threshold value (1)). If the learning condition is satisfied (YES at S106), the process proceeds to S108. Otherwise (NO at S106), the process proceeds to S110.

At S108, engine ECU 300 updates the learn value. As described above, the learn value is updated by adding to or subtracting from the previously calculated learn value, an update amount determined based on the map.

At S110, engine ECU 300 calculates the fuel correction amount. As described above, in the present embodiment, the fuel correction amount is the sum of the feedback correction amount and the learn value. When the amount of fuel injection from the injector is appropriate (when the injector is normal), relation of rich-abnormality determination value≦fuel correction amount≦lean-abnormality determination value is satisfied.

Here, the rich-abnormality determination value refers to a threshold value used for determining abnormality such as excessive amount of fuel injection from the injector (hereinafter, also denoted as rich-abnormality). Meanwhile, the lean-abnormality determination value refers to a threshold value used for determining abnormality such as insufficient amount of fuel injection from the injector (hereinafter, also denoted as lean-abnormality).

At S112, engine ECU 300 determines whether or not the relation of rich-abnormality determination value≦fuel correction amount≦lean-abnormality determination value is satisfied. If the relation of rich-abnormality determination value≦fuel correction amount≦lean-abnormality determination value is satisfied (YES at S112), the process proceeds to S118. Otherwise (NO at S112), the process proceeds to S114.

Figure 8:
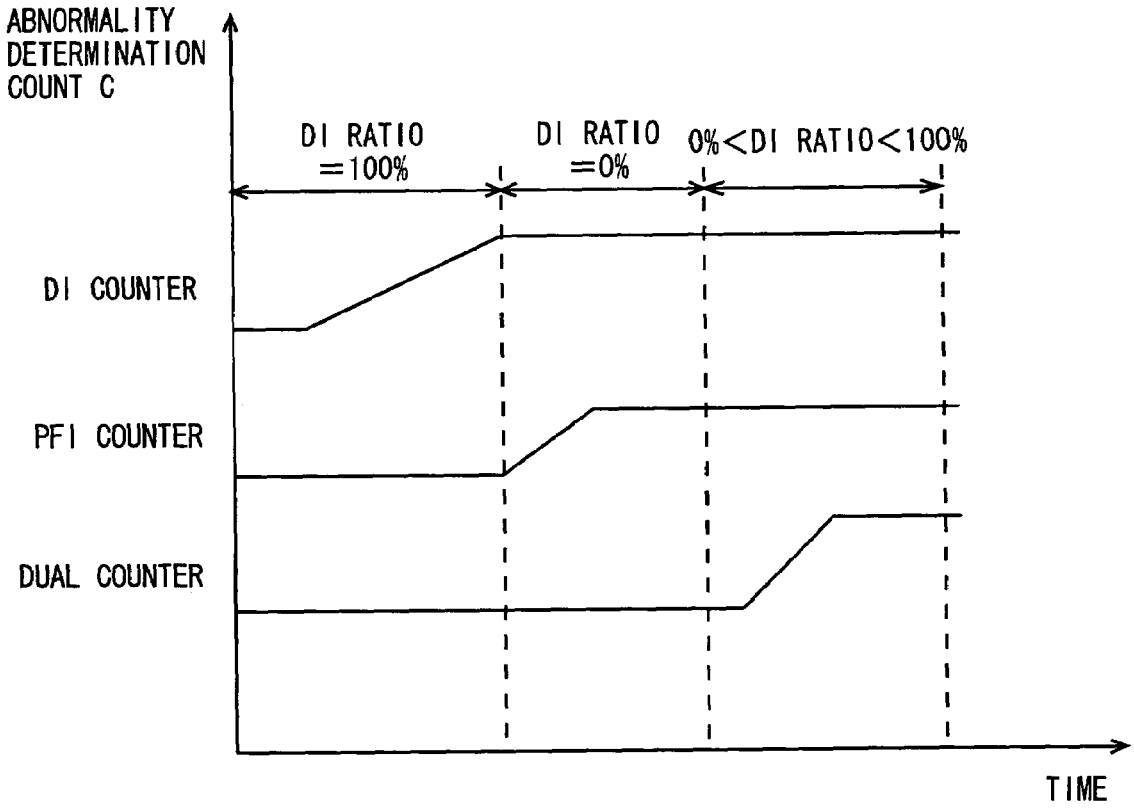
FIG. 8 shows abnormality determination count C counted for each injection region by a DI counter, a PFI counter and a DUAL counter of the engine ECU that serves as the state determination device according to the first embodiment of the present invention.

At S114, engine ECU 300 determines the injector as abnormal. At S118, engine ECU 300 adds "1" to abnormality determination count C. As shown in FIG. 8, engine ECU 300 has three counters of a DI counter, a PFI counter and a DUAL counter.

The DI counter counts the number of times the injector is determined as abnormal in the region where DI ratio r=100%. That is, the DI counter counts the number of times the injector is determined as abnormal when the fuel is injected solely from in-cylinder injector 110. Therefore, if the injector is determined as abnormal in the region where DI ratio r=100%, "1" is added to abnormality determination count C in the DI counter.

The PFI counter counts the number of times the injector is determined as abnormal in the region where DI ratio r=0%. That is, the PFI counter counts the number of times the injector is determined as abnormal when the fuel is injected solely from intake manifold injector 120. Therefore, if the injector is determined as abnormal in the region where DI ratio r=0%, "1" is added to abnormality determination count C in the PFI counter.

The DUAL counter counts the number of times the injector is determined as abnormal in the region where 0%<DI ratio r<100%. That is, the DUAL counter counts the number of times the injector is determined as abnormal when the fuel is injected from in-cylinder injector 110 and intake manifold injector 120. Therefore, if the injector is determined as abnormal in the region where 0%<DI ratio r<100%, "1" is added to abnormality determination count C in the DUAL counter.

Referring again to FIG. 7, at S118, engine ECU 300 determines whether or not abnormality determination count C is greater than a threshold value C(0) (C(0) is an integer equal to or larger than 0). When abnormality determination count C is greater than threshold value C(0) (YES at S118), the process proceeds to S120. Otherwise (NO at S118), the process proceeds to S124.

At S120, engine ECU 300 causes RAM 330 to store abnormality determination count C. At S122, engine ECU 300 resets the counter.

At S124, engine ECU 300 determines the DI ratio based on the maps shown in FIGS. 2 and 3. At S126, engine ECU 300 determines whether or not DI ratio r has been changed. If DI ratio r has been changed (YES at S126), the process proceeds to S128. Otherwise (NO at S126), the process returns to S102. At S128, engine ECU 300 causes RAM 330 to store abnormality determination count C. Thereafter, the process ends.

Figure 9:
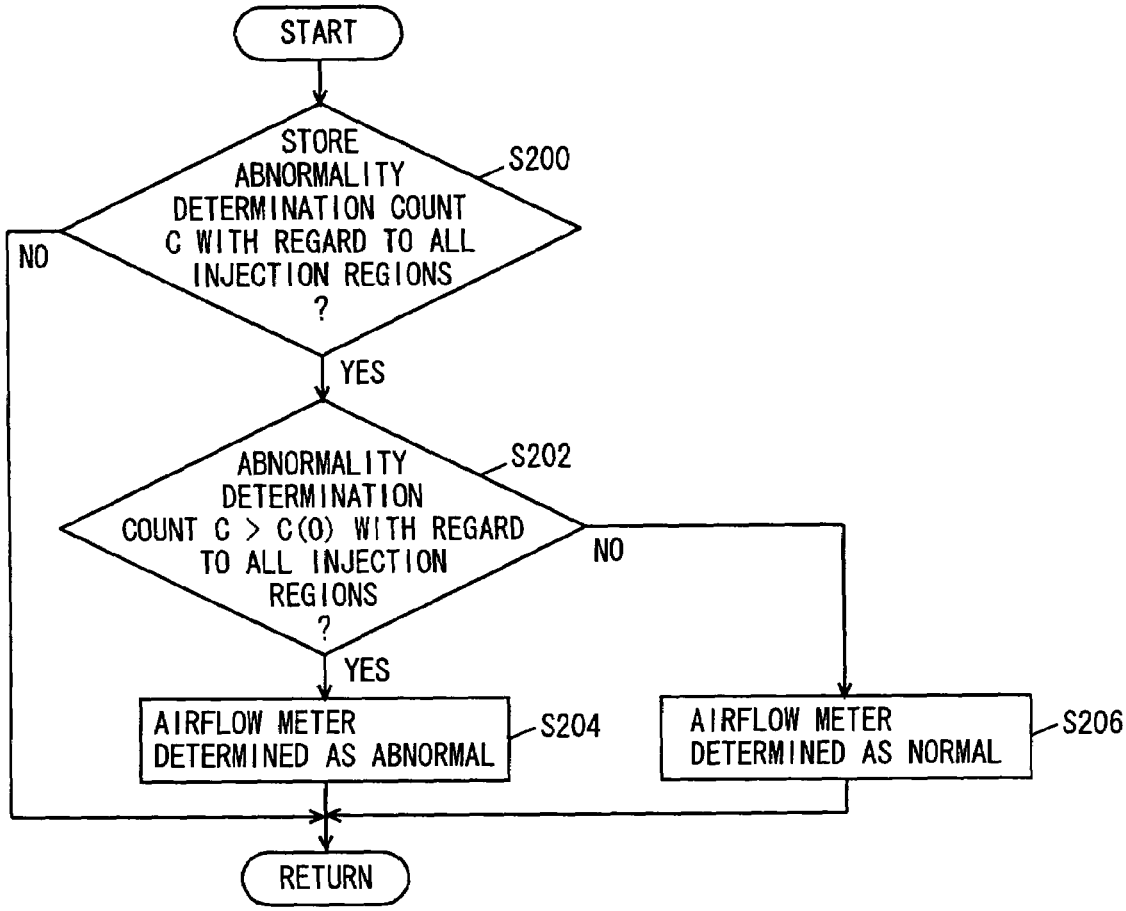
FIG. 9 is a second flowchart showing a control configuration of a program executed by the engine ECU serving as the state determination device according to the first embodiment of the present invention.

A control configuration of a program executed when engine ECU 300 serving as the state determination device for the internal combustion engine according to the present embodiment determines a state of airflow meter 42 will be described with reference to FIG. 9.

At S200, engine ECU 300 determines whether or not abnormality determination counts C for all injection regions have been stored. When abnormality determination counts C for all injection regions are stored (YES at S200), the process proceeds to S202. Otherwise (NO at S200), the process ends.

At S202, engine ECU 300 determines whether or not abnormality determination count C is greater than threshold value C(0) in all, injection regions. When abnormality determination count C is greater than threshold value C(0) in all injection regions (YES at S202), the process proceeds to S204. Otherwise (NO at S202), the process proceeds to S206.

At S204, engine ECU 300 determines airflow meter 42 as abnormal. At S206, engine ECU 300 determines airflow meter 42 as normal.

An operation of engine ECU 300 serving as the state determination device for the internal combustion engine according to the present embodiment based on the configuration and the flowchart above will now be described.

During operation of the engine, the DI ratio is determined based on the maps shown in FIGS. 2 and 3 (S100) and the air-fuel ratio is detected based on the signal transmitted from air-fuel ratio sensor 420 (S102). The feedback correction amount for the amount of fuel injection is calculated based on the air-fuel ratio (S104).

For example, if a learning condition that the average (control median) of the feedback correction amounts is smaller than threshold value (1) or larger than threshold value (2) (threshold value (2)>threshold value (1)) is satisfied (YES at S106), the learn value is updated (S108). If the learning condition is not satisfied (NO at S106), the learn value is not updated.

The fuel correction amount is calculated as the sum of the feedback correction amount and the learn value (S110), and whether or not the relation of rich-abnormality determination value≦fuel correction amount≦lean-abnormality determination value is satisfied is determined in order to determine the state of the injector (S112).

When the fuel correction amount is smaller than the rich-abnormality determination value (fuel correction amount<rich-abnormality determination value) (NO at S112), the amount of fuel injection from the injector exceeds the target injection amount and it can be said that the amount of fuel injection has significantly been decreased.

On the other hand, when the fuel correction amount is greater than the lean-abnormality determination value (fuel correction amount>lean-abnormality determination value) (NO at S112), the amount of fuel injection from the injector is smaller than the target injection amount and it can be said that the amount of fuel injection has significantly been increased.

In these cases, the injector is determined as abnormal (S114). If DI ratio r=100%, "1" is added to abnormality determination count C of the DI counter; if DI ratio r=0%, "1" is added to abnormality determination count C of the PFI counter; and if 0%<DI ratio r<100%, "1" is added to abnormality determination count C of the DUAL counter (S116).

When abnormality determination count C is greater than threshold value C(0) (YES at S118), abnormality determination count C is stored in RAM 330 (S120). Here, if DI ratio r=100%, abnormality determination count C of the DI counter is stored in RAM 330; if DI ratio r=0%, abnormality determination count C of the PFI counter is stored in RAM 330; and if 0%<DI ratio r<100%, abnormality determination count C of the DUAL counter is stored in RAM 330 (S120). Thereafter, abnormality determination count C is reset (S122).

On the other hand, when abnormality determination count C is smaller than threshold value C(0) (NO at S118), DI ratio r is determined (S124). When DI ratio r is changed (YES at S126), abnormality determination count C is stored in RAM 330 (S128).

If DI ratio r is set to 100% (DI ratio r=100%) before the change, abnormality determination count C of the DI counter is stored in RAM 330; if DI ratio r is set to 0% (DI ratio r=0%) before the change, abnormality determination count C of the PFI counter is stored in RAM 330; and if DI ratio r is greater than 0% and smaller than 100% (0%<DI ratio r<100%), abnormality determination count C of the DUAL counter is stored in RAM 330 (S128).

When abnormality determination count C with regard to all injection regions is stored (YES at S200), whether or not abnormality determination count C is greater than threshold value C(0) is determined for all injection regions (S202) in order to determine the state of airflow meter 42.

The amount of fuel injection is calculated based on the amount of air detected by airflow meter 42. Accordingly, if airflow meter 42 is abnormal, the amount of fuel injection may be inappropriate in all injection regions. In such a case, the air-fuel ratio differs from the desired air-fuel ratio in all injection regions, and the injector is determined as abnormal more frequently.

Therefore, when abnormality determination count C is greater than threshold value C(0) (YES at S202), airflow meter 42 is determined as abnormal (S204). The state of airflow meter 42 can thus be determined.

On the other hand, when abnormality determination count C is smaller than threshold value C(0) in at least one of the three injection regions (NO at S202), it can be said that the air-fuel ratio close to the desired air-fuel ratio is attained and an appropriate amount of fuel is injected more frequently at least in that region. In such a case, it is likely that the intake air amount has accurately been detected. Therefore, when abnormality determination count C is smaller than threshold value C(0) in at least one of the three injection regions (NO at S202), airflow meter 42 is determined as normal (S206). The state of airflow meter 42 can thus be determined.

As described above, according to the engine ECU serving as the state determination device of the present embodiment, whether the injector is abnormal or not is determined for each injection region. The amount of fuel injection is calculated based on the amount of air detected by the airflow meter. Accordingly, if the airflow meter is abnormal, the amount of fuel injection may be inappropriate in all injection regions. In such a case, the air-fuel ratio differs from the desired air-fuel ratio in all injection regions, and the injector is determined as abnormal more frequently. Therefore, when abnormality determination count C is greater than threshold value C(0) in all injection regions, the airflow meter is determined as abnormal. On the other hand, when abnormality determination count C is smaller than threshold value C(0) in at least any one of the three injection regions, it can be said that the air-fuel ratio close to the desired air-fuel ratio is attained and an appropriate amount of fuel is injected more frequently at least in that region. In such a case, it is likely that the intake air amount has accurately been detected. Therefore, when abnormality determination count C is smaller than threshold value C(0) in at least any one of the three injection regions, airflow meter 42 is determined as normal. The state of the airflow meter can thus be determined.

In the present embodiment, the state of the injector has been determined in all injection regions, however, the state of the injector may be determined in at least any two injection regions. In such a case, airflow meter 42 may be determined as abnormal when abnormality determination count C is greater than threshold value C(0) in at least any two injection regions, that is, in all injection regions in which the state of the injector has been determined.

In addition, in the present embodiment, the state of airflow meter 42 is determined based on abnormality determination count C, however, the state of airflow meter 42 may be determined based not only on abnormality determination count C but also on a fuel injection time period (a time period during which the injector is open).

For example, during idling, as engine 10 is controlled to attain a desired engine speed, the intake air amount (or charge efficiency) is predictable. As the injection time period is obtained based on the amount of fuel injection set in accordance with the intake air amount, in the operation state in which the intake air amount is predictable such as during idling, the injection time period in a case where airflow meter 42 and the injector are assumed as normal is predictable. In other words, the injection time period in this case is set to an injection time period (basic injection time period) obtained based on the amount of fuel injection corresponding to the predicted intake air amount (charge efficiency).

Meanwhile, when the fuel injection amount is corrected as a result of air-fuel ratio feedback control, the actual fuel injection amount is obtained as the sum of the fuel injection amount based on the intake air amount and the fuel correction amount, from which the injection time period is in turn obtained.

Therefore, if the relation of fuel correction amount<rich-abnormality determination value or the relation of fuel correction amount>lean-abnormality determination value is satisfied and the actual injection time period in such a case is nevertheless the same as the injection time period in a case where airflow meter 42 and the injector are assumed as normal during idling, the detected intake air amount differs from the intake air amount predicted during idling. Here, it cannot be said that the intake air amount is accurately detected.

Therefore, airflow meter 42 may be determined as abnormal if abnormality determination count C is greater than threshold value C(0) in all injection regions on the premise that deviation between the actual injection time period and the predictable injection time period is smaller than predetermined deviation when the injector is determined as abnormal during idling. The state of airflow meter 42 can thus be determined with high accuracy.

On the other hand, the injector used in the injection region where abnormality determination count C is greater than threshold value C(0) may be determined as abnormal if deviation between the actual injection time period and the predictable injection time period is greater than predetermined deviation in that injection region. The state of the injector can thus be determined with high accuracy. It is noted that the actual injection time period and the predictable injection time period during a period other than idling may be compared.

Second Embodiment

Figure 10:
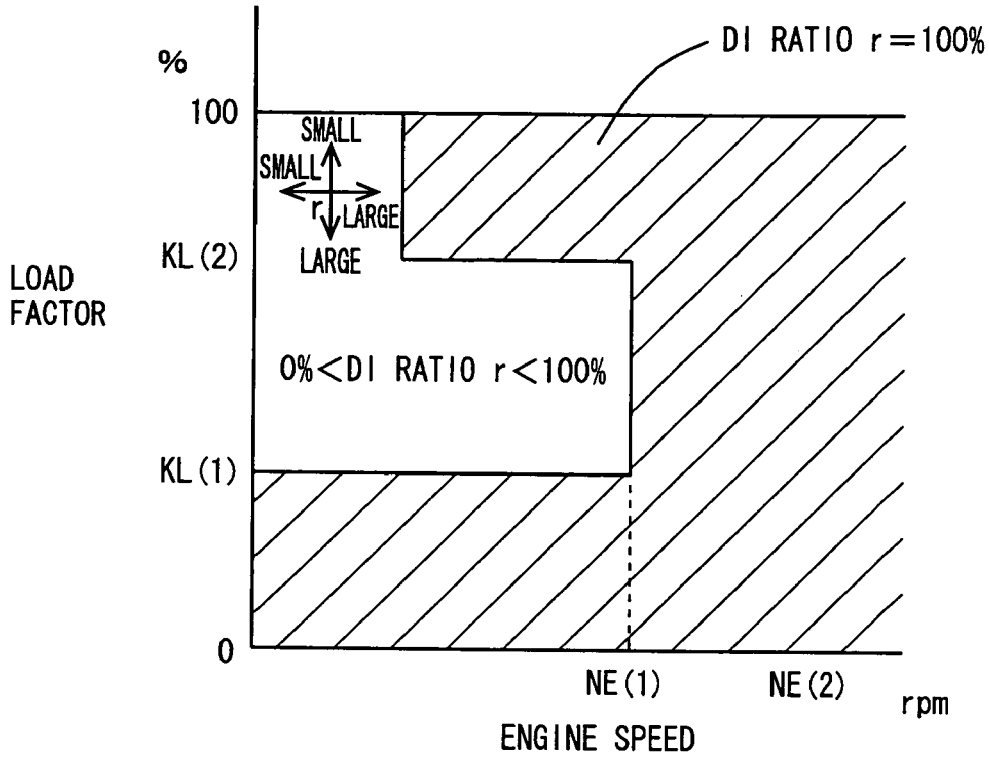
FIGS. 10 and 11 illustrate DI ratio maps in a warm state and a cold state respectively, stored in an engine ECU serving as a state determination device according to a second embodiment of the present invention.
Figure 11:
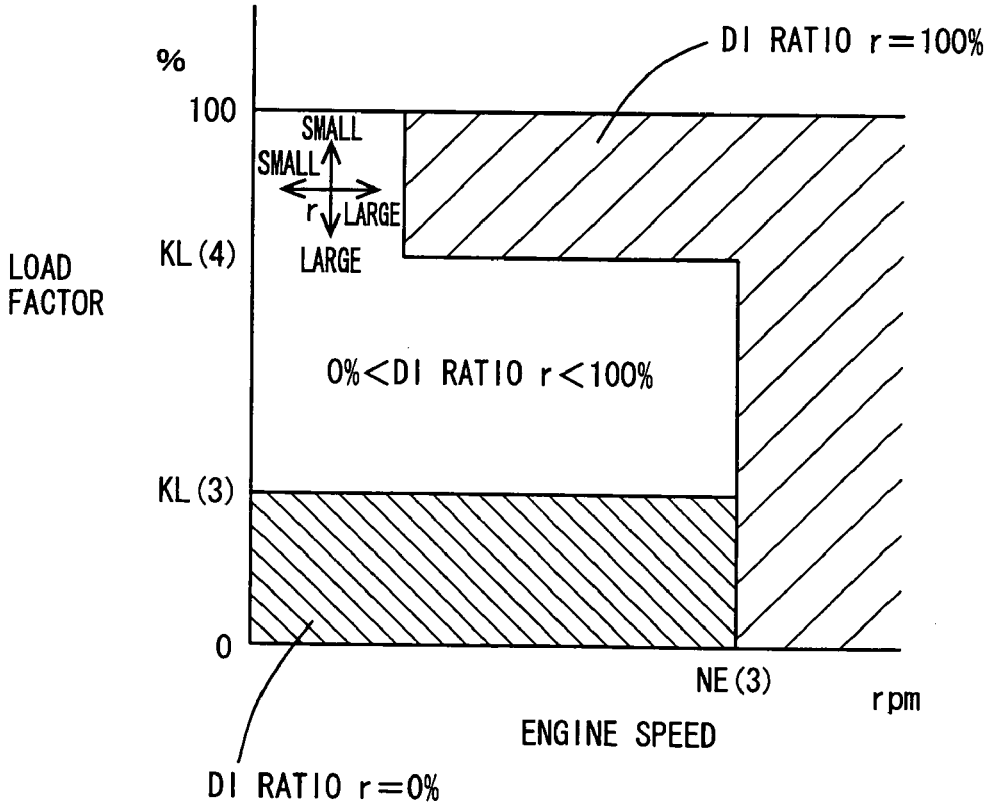

Referring to FIGS. 10 and 11, a second embodiment of the present invention will be described. In the present embodiment, DI ratio r is calculated using a map different from those in the first embodiment described previously.

As the configuration and the process flow as well as functions thereof are otherwise the same as those in the first embodiment described previously, detailed description thereof will not be repeated.

Referring to FIGS. 10 and 11, maps each indicating the fuel injection ratio between in-cylinder injector 110 and intake manifold injector 120, identified as information associated with the operation state of engine 10, will be described. The maps are stored in ROM 320 of engine ECU 300. FIG. 10 is the map for the warm state of engine 10, and FIG. 11 is the map for the cold state of engine 10.

FIGS. 10 and 11 differ from FIGS. 2 and 3 in the following points. "DI RATIO r=100%" holds in the region where the engine speed of engine 10 is equal to or higher than NE(1) in the map for the warm state, and in the region where engine 10 speed is NE(3) or higher in the map for the cold state. Further, except for the low-speed region, "DI RATIO r=100%" holds in the region where the load factor is KL(2) or greater in the map for the warm state, and in the region where the load factor is KL(4) or greater in the map for the cold state. This means that fuel injection is carried out using only in-cylinder injector 110 in the region where the engine speed is at a predetermined high level, and that fuel injection is often carried out using only in-cylinder injector 110 in the region where the engine load is at a predetermined high level. However, in the low-speed and high-load region, mixing of an air-fuel mixture formed by the fuel injected from in-cylinder injector 110 is poor, and such inhomogeneous air-fuel mixture within the combustion chamber may lead to unstable combustion. Thus, the fuel injection ratio of the in-cylinder injector is increased as the engine speed increases where such a problem is unlikely to occur, whereas the fuel injection ratio of in-cylinder injector 110 is decreased as the engine load increases where such a problem is likely to occur. These changes in the DI ratio r are shown by crisscross arrows in FIGS. 10 and 11. In this manner, variation in output torque of the engine attributable to the unstable combustion can be suppressed. It is noted that these measures are approximately equivalent to the measures to decrease the fuel injection ratio of in-cylinder injector 110 as the state of engine 10 moves toward the predetermined low speed region, or to increase the fuel injection ratio of in-cylinder injector 110 as engine 10 state moves toward the predetermined low load region. Further, except for the relevant region (indicated by the crisscross arrows in FIGS. 10 and 10), in the region where fuel injection is carried out using only in-cylinder injector 110 (on the high speed side and on the low load side), a homogeneous air-fuel mixture is readily obtained even when the fuel injection is carried out using only in-cylinder injector 110. In this case, the fuel injected from in-cylinder injector 110 is atomized within the combustion chamber involving latent heat of vaporization (by absorbing heat from the combustion chamber). Accordingly, the temperature of the air-fuel mixture is decreased at the compression end, and thus, the antiknock performance improves. Further, with the temperature of the combustion chamber decreased, intake efficiency improves, leading to high power output.

In engine 10 explained in the first and second embodiments, homogeneous combustion is achieved by setting the fuel injection timing of in-cylinder injector 110 in the intake stroke, while stratified charge combustion is realized by setting it in the compression stroke. That is, when the fuel injection timing of in-cylinder injector 110 is set in the compression stroke, a rich air-fuel mixture can be located locally around the spark plug, so that a lean air-fuel mixture in the combustion chamber as a whole is ignited to realize the stratified charge combustion. Even if the fuel injection timing of in-cylinder injector 110 is set in the intake stroke, stratified charge combustion can be realized if it is possible to provide a rich air-fuel mixture locally around the spark plug.

As used herein, the stratified charge combustion includes both the stratified charge combustion and semi-stratified charge combustion. In the semi-stratified charge combustion, intake manifold injector 120 injects fuel in the intake stroke to generate a lean and homogeneous air-fuel mixture in the whole combustion chamber, and then in-cylinder injector 110 injects fuel in the compression stroke to generate a rich air-fuel mixture around the spark plug, so as to improve the combustion state. Such semi-stratified charge combustion is preferable in the catalyst warm-up operation for the following reasons. In the catalyst warm-up operation, it is necessary to considerably retard the ignition timing and maintain a favorable combustion state (idle state) so as to cause a high-temperature combustion gas to reach the catalyst. Further, a certain quantity of fuel needs to be supplied. If the stratified charge combustion is employed to satisfy these requirements, the quantity of the fuel will be insufficient. If the homogeneous combustion is employed, the retarded amount for the purpose of maintaining favorable combustion is small compared to the case of stratified charge combustion. For these reasons, the above-described semi-stratified charge combustion is preferably employed in the catalyst warm-up operation, although either of stratified charge combustion and semi-stratified charge combustion may be employed.

Further, in the engine explained in the first and second embodiments, the fuel injection timing of in-cylinder injector 110 is preferably set in the intake stroke in a basic region corresponding to the almost entire region (here, the basic region refers to the region other than the region where semi-stratified charge combustion is carried out with fuel injection from intake manifold injector 120 in the intake stroke and fuel injection from in-cylinder injector 110 in the compression stroke, which is carried out only in the catalyst warm-up state). The fuel injection timing of in-cylinder injector 110, however, may be set temporarily in the compression stroke for the purpose of stabilizing combustion, for the following reasons.

When the fuel injection timing of in-cylinder injector 110 is set in the compression stroke, the air-fuel mixture is cooled by the injected fuel while the temperature in the cylinder is relatively high. This improves the cooling effect and, hence, the antiknock performance. Further, when the fuel injection timing of in-cylinder injector 110 is set in the compression stroke, the time from the fuel injection to the ignition is short, which ensures strong penetration of the sprayed fuel, so that the combustion rate increases. The improvement in antiknock performance and the increase in combustion rate can prevent variation in combustion, and thus, combustion stability is improved.

Regardless of the temperature of engine 10 (that is, whether engine 10 is in the warm state or in the cold state), the warm state map shown in FIG. 2 or 10 may be used during idle-off state (when an idle switch is off, or when the accelerator pedal is pressed) (regardless of whether engine 10 is in the cold state or in the warm state, in the low load region, in-cylinder injector 110 is used).

Although the present invention has been described and illustrated in detail, it is clearly understood that the same is by way of illustration and example only and is not to be taken by way of limitation, the spirit and scope of the present invention being limited only by the terms of the appended claims.

The invention claimed is:

1. A state determination device for an internal combustion engine, said internal combustion engine including a first fuel injection mechanism injecting fuel into a cylinder and a second fuel injection mechanism injecting fuel into an intake manifold, comprising:

a first control unit controlling said fuel injection mechanism so that the fuel is injected solely from said first fuel injection mechanism in a first injection region;

a second control unit controlling said fuel injection mechanism so that the fuel is injected solely from said second fuel injection mechanism in a second injection region;

a third control unit controlling said fuel injection mechanism so that the fuel is injected from said first fuel injection mechanism and said second fuel injection mechanism in a third injection region;

an intake air amount detection unit detecting an amount of air suctioned into said internal combustion engine;

a calculation unit calculating an amount of fuel injection from said fuel injection mechanism based on the amount of air;

an air-fuel ratio detection unit detecting an air-fuel ratio;

a first determination unit determining a state of said fuel injection mechanism based on the air-fuel ratio in at least any two of said first injection region, said second injection region and said third injection region; and a second determination unit determining a state of said intake air amount detection unit based on a result of determination by said first determination unit.

2. The state determination device for an internal combustion engine according to claim 1, wherein said second determination unit determines said intake air amount detection unit as abnormal when number of times said fuel injection mechanism is determined as abnormal is greater than predetermined number of times in all injection regions for which the state of said fuel injection mechanism has been determined by said first determination unit.

3. The state determination device for an internal combustion engine according to claim 1, wherein said second determination unit determines said intake air amount detection unit as normal when number of times said fuel injection mechanism is determined as abnormal is smaller than predetermined number of times in at least any one of said first injection region, said second injection region and said third injection region.

4. The state determination device for an internal combustion engine according to claim 1, further comprising a third determination unit determining said fuel injection mechanism as abnormal when deviation between an actual time period for fuel injection from said fuel injection mechanism and a predetermined time period is greater than predetermined deviation in an injection region in which number of times said fuel injection mechanism is determined as abnormal by said first determination unit is greater than predetermined number of times.

5. The state determination device for an internal combustion engine according to claim 1, wherein said first fuel injection mechanism is an in-cylinder injector, and said second fuel injection mechanism is an intake manifold injector.

6. The state determination device for an internal combustion engine according to claim 1, wherein said intake air amount detection unit is an airflow meter.

7. A state determination device for an internal combustion engine, said internal combustion engine including first fuel injection means for injecting fuel into a cylinder and second fuel injection means for injecting fuel into an intake manifold, comprising:

first control means for controlling said fuel injection means so that the fuel is injected solely from said first fuel injection means in a first injection region;

second control means for controlling said fuel injection means so that the fuel is injected solely from said second fuel injection means in a second injection region;

third control means for controlling said fuel injection means so that the fuel is injected from said first fuel injection means and said second fuel injection means in a third injection region;

intake air amount detection means for detecting an amount of air suctioned into said internal combustion engine;

means for calculating an amount of fuel injection from said fuel injection means based on the amount of air;

means for detecting an air-fuel ratio;

first determination means for determining a state of said fuel injection means based on the air-fuel ratio in at least any two of said first injection region, said second injection region and said third injection region; and second determination means for determining a state of said intake air amount detection means based on a result of determination by said first determination means.

8. The state determination device for an internal combustion engine according to claim 7, wherein said second determination means includes means for determining said intake air amount detection means as abnormal when number of times said fuel injection means is determined as abnormal is greater than predetermined number of times in all injection regions for which the state of said fuel injection means has been determined by said first determination means.

9. The state determination device for an internal combustion engine according to claim 7, wherein said second determination means includes means for determining said intake air amount detection means as normal when number of times said fuel injection means is determined as abnormal is smaller than predetermined number of times in at least any one of said first injection region, said second injection region and said third injection region.

10. The state determination device for an internal combustion engine according to claim 7, further comprising third determination means for determining said fuel injection means as abnormal when deviation between an actual time period for fuel injection from said fuel injection means and a predetermined time period is greater than predetermined deviation in an injection region in which number of times said fuel injection means is determined as abnormal by said first determination means is greater than predetermined number of times.

11. The state determination device for an internal combustion engine according to claim 7, wherein said first fuel injection means is an in-cylinder injector, and said second fuel injection means is an intake manifold injector.

12. The state determination device for an internal combustion engine according to claim 7, wherein said intake air amount detection means is an airflow meter.

* * * * *